United States Patent [19]

Nakamura et al.

[11] 4,164,683

[45] Aug. 14, 1979

[54] FLUORESCENT DISPLAY TUBE

[75] Inventors: Tadashi Nakamura, Ise; Mitsuru Masuda, Matsuzaka; Hiroshi Tanaka, Takarazuka, all of Japan

[73] Assignees: ISE Electronics Corporation; Fujitsu Ten Limited, both of Japan

[21] Appl. No.: 917,412

[22] Filed: Jun. 21, 1978

[30] Foreign Application Priority Data

Jun. 27, 1977 [JP] Japan ..... 52-76383

[51] Int. Cl.[2] ..... H01J 63/02; H01J 63/04

[52] U.S. Cl. ..... 313/496; 313/513; 334/86

[58] Field of Search ..... 313/496, 497, 519, 510, 313/517, 513; 334/86

[56] References Cited

U.S. PATENT DOCUMENTS

| | | | |
|---|---|---|---|
| 3,289,198 | 11/1966 | Dickson, Jr. et al. | 313/510 X |
| 3,325,664 | 6/1967 | Buck, Jr. et al. | 313/510 |
| 3,343,155 | 9/1967 | Pahlavan | 313/510 X |
| 3,609,750 | 9/1971 | Budd et al. | 313/210 X |
| 3,657,587 | 4/1972 | Kegelman | 313/496 |
| 3,703,657 | 11/1972 | Shesser | 313/519 |
| 3,962,642 | 6/1976 | Kitamura et al. | 334/86 X |
| 4,040,719 | 8/1977 | Schiebelhuth | 334/86 X |

*Primary Examiner*—Palmer C. Demeo

*Attorney, Agent, or Firm*—Charles W. Helzer

[57] ABSTRACT

The fluorescent display tube is of the flat tube type driven by a dynamic drive system. The tube comprises a transparent envelope made up of a flat substrate and a cover spaced therefrom. A first display unit is formed on the inner surface of the substrate while a second display unit is formed on the inner surface of the cover. Each of the first and second display units comprises electrodes arranged in a pattern to be displayed and phosphor films coated on the electrodes. The electrodes of the second display unit are made of transparent material. Where the electrodes of respective display units are selectively energized the phosphor films on the selected electrodes are caused to fluoresce by thermal electrons generated by a cathode electrode thus displaying a desired pattern.

7 Claims, 6 Drawing Figures

FLUORESCENT DISPLAY TUBE

BACKGROUND OF THE INVENTION

This invention relates to a flat type fluorescent display tube capable of displaying a plurality of digits, letters or symbols.

As is well known in the art, a prior art fluorescent tube adapted to display digits of a number of orders of magnitude comprises an insulating substrate formed with a plurality of digit display units, a plurality of independent digit selection grids mounted on the insulating substrate to respectively oppose the digits, and a cathode electrode for emitting thermal electrons. At least the display units, the grids and the cathode electrode are sealed in a vacuum envelope. Such prior art tube is disclosed in U.S. Pat. No. 3,723,789 to Tanji. Each digit display unit is constituted by a plurality of segment electrodes, and phosphor films coated on the segment electrodes. Corresponding segments of the digit display units are commonly connected to external terminals so as to display a desired digit of a desired order by using so-called dynamic drive and by designating a digit selecting grid.

In the fluorescent display tube of the dynamic driving type described above, since the digit display units are arranged in a plane on the substrate, where it is desired to increase the number of digits, there arises the following problems.

Firstly, if one wishes to increase the number of displayable digits without increasing the size of the substrate, it is necessary to decrease the size of the digit display units and to decrease the spacing between adjacent display units. However, small display units are difficult to see. Moreover it is impossible to decrease the spacing between the digit display units beyond a certain limit from the standpoints of electric insulation and construction.

It is also possible to increase the size of the substrate. This not only increases the size of the tube but also results in the change of the layout of a device into which the display tube is to be incorporated.

SUMMARY OF THE INVENTION

Accordingly, it is an object of this invention to provide an improved flat type fluorescent display tube capable of increasing the amount of display without increasing the size of the tube.

Another object of this invention is to provide a fluorescent display tube wherein the number of the component parts is minimized.

Still another object of this invention is to provide a novel fluorescent display tube capable of being fabricated by prior art methods of manufacturing.

A further object of this invention is to provide a novel fluorescent display tube capable of causing a viewer to correctly recognize the relationship between different display information by displaying the information in an overlapped relationship.

Still a further object of this invention is to provide an improved fluorescent display tube capable of increasing the amount of display and decreasing the spacing between displayed digits without changing the size of the tube.

Yet another object of this invention is to provide a novel fluorescent displays of tube wherein different display information is displayed in an overlapped relationship so as to obtain one impression by combining such different displays of information.

According to one aspect of this invention there is provided a fluorescent display tube of the type comprising a sealed envelope made up of spaced plates, one of which is transparent, a first display unit formed on the inner surface of a plate opposing the transparent plate, said first display unit including a plurality of electrodes and phosphor films coated thereon, a cathode electrode for emitting thermal electrons, and drive means for selectively energizing the electrodes for causing the phosphor films to luminesce with the thermal electrons, characterized by a second display unit which includes a plurality of electrodes formed on the inner surface of the transparent plate and phosphor films coated on the last mentioned electrodes.

According to another aspect of this invention there is provided a fluorescent display tube for use in a dial display unit of a radio receiver, characterized in that said fluorescent display tube comprises a flat sealed envelope with one side wall made of transparent material, a series of fluorescent segments formed on the inner surface of the other side wall opposing the transparent side wall, means for selecting the fluorescent segments in accordance with the frequency of the wave received by the receiver, and a fluorescent channel display member formed on the inner surface of the transparent side wall, the channel display member being in the form of a letter which displays the frequencies corresponding to a plurality of received bands.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1:
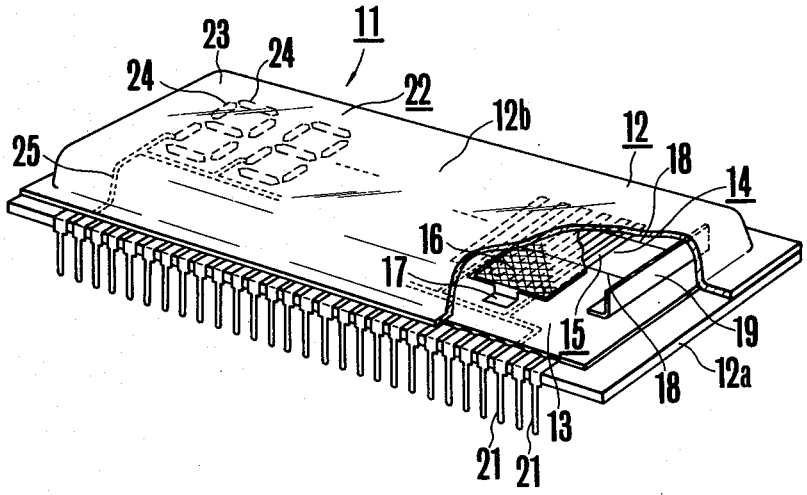
FIG. 1 is a perspective view, partly broken away, showing one embodiment of a fluorescent display tube embodying the invention.
Figure 2:
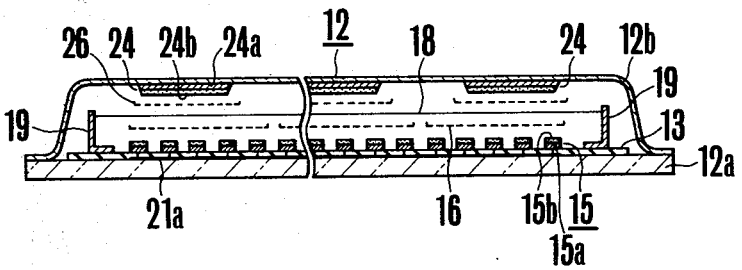
FIG. 2 is a longitudinal sectional view of the fluorescent display tube shown in FIG. 1.

A preferred embodiment of the fluorescent display tube 11 shown in FIGS. 1 and 2 comprises a transparent envelope 12 made of glass, for example, and constituted by a substrate 12*a* and a cover 12*b*. In this example, a first display unit 14 formed on the substrate 12*a* through an insulating film 13 is used to display a bar graph and made up of a plurality of parallel rod shaped segments arranged side by side in an array extending in the longitudinal direction of the substrate 12*a*. Each rod shaped segment 15 comprises a segment electrode 15*a* and a phosphor film 15*b* applied thereon. The rod shaped segments 15 are divided into a plurality of groups each including a predetermined number of segments. A plurality of mesh shaped grids 16, one for each group, are secured to the substrate 12 by supports 17 with a definite spacing between the grids and the segments. A cathode filament 18 is supported by anchors 19 at a definite distance from the grids 16. Corresponding segment electrodes 15*a* of the respective groups are commonly connected to wiring layers 21*a* arranged beneath an insulating film 13 by so-called through hole technique. The wiring layers 21*a* are respectively connected to external terminals 21 and each grid 16 is connected to one external terminal 21 through another wiring layer, not shown. The segment electrodes and the wiring layers may be arranged in the same plane in which case it is unnecessary to rely upon the through hole technique. According to this invention, on the inner wall of the cover 12*b* of the envelope 12 is mounted a second display unit 22. This unit comprises a plurality of digit display unit 23 each including a plurality of segments 24 which are arranged in the form of a letter 8. Each segment comprises a transparent electrode 24*a* and a transparent phosphor film 24*b* applied thereon. Corresponding transparent electrodes 24*a* of different digit display units 23 are commonly connected to respective terminals 21 through transparent wiring layers 25 formed on the inner wall of the cover 12*b*. It is advantageous to arrange the wiring layers 25 in the same plane. Mesh shaped grids 26 are provided to oppose respective digit display units 23 of the second display unit 22 with a definite spacing therebetween. Each grid 26 is connected to an independent terminal 21.

When the first display unit 14 of the fluorescent tube 11 is driven by a well known dynamic driving system it is possible to display input information in an analogue form in the longitudinal direction of the tube. Since the digit display units 23 are transparent the analogue display of the first display unit 14 can be clearly seen from the front side of the fluorescent display tube without any obstruction. Although it is preferred to operate only the first display unit 14, or the second display unit 22 it is possible to simultaneously operate both the first and second display units 14 and 22 for displaying input information with two types of displays, that is analogue and digital displays. Since the driving circuit of the display tube is well known in the art, it is not necessary to describe it.

Figure 3:
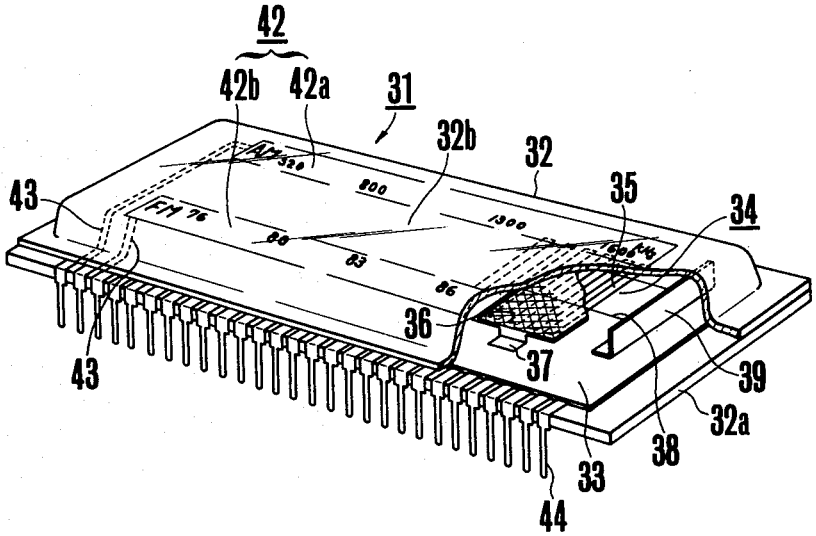
FIG. 3 is a perspective view, partly in section, showing one example of the fluorescent tube utilized as an office selection dial display device in a radio receiver.

FIG. 3 shows a modified embodiment of the fluorescent display tube of this invention described for use as a dial display device of a FM/AM radio receiver. In this embodiment, the structure on the upper surface of a substrate 32*a* contained in an envelope 32 of the fluorescent display tube 31, is the same as that shown in FIG. 1, and comprises a first display unit 34 including a plurality of parallel rod shaped segments 35, and an insulating film 33 corresponding to the insulating film 13 shown in FIG. 1. The first display unit 34 corresponds to the first display unit 14 shown in FIG. 1. Similarly, a second display unit 42 is formed on the inner wall of a cover 32*b* of the envelope 32. The second display unit 42 comprises an AM channel display element 42*a* and a FM channel display element 42*b* which take the form of webs extending in the longitudinal direction of the tube. Each display element is constituted by a transparent electrode and a phosphor coated thereon and connected to a corresponding one of the external terminals 44 through a transparent wiring layer 43 applied to the inner wall of the cover 32*b*. In FIG. 3, reference numeral 36 shows mesh shaped grids, 37 their supports, 38 a cathode filament, and 39 anchors of the cathode filament. These elements have the same construction as those shown in FIGS. 1 and 2. The modified fluorescent display tube can be used as an office selection dial display device of a radio receiver by operating the first display unit 34 to display the received frequency in an analogue manner by excitation of a selected rod-shaped segment under the appropriate number of a received frequency band, and by causing to luminesce only a portion of the second display unit 42, for example the AM band, corresponding to the received frequency band.

Selection of The channel display elements 42*a* and 42*b* is made, for example, by supplying a signal to either one of them in an interlocked relationship with the operation of an AM/FM receiving range selection switch. the first display unit 34 is connected to display the received frequency information within the respective receiving ranges. Such information is sent to a $\frac{3}{4}$ step counter via a frequency divider which divides the output frequency of a local oscillator. This counter is constructed to receive one pulse at each 10 KHz in the case of AM, whereas at each 100 KHz in the case of FM to produce one pulse at each 30 KHz in the case of AM, whereas at each 400 KHz in the case of FM. The output of the $\frac{3}{4}$ step counter is sent to a preset counter which is connected to receive from a preset input device digital information corresponding to the first frequency of the broadcasting frequency band. The preset counter commences its counting operation when the value of the digital information coincides with a complement of the output of the $\frac{3}{4}$ step counter thus sending its count corresponding to the broadcasting frequency band to the first display unit via a decoder. The signal sent from the preset counter is used to select the grids and the rod shaped segments of the first display unit.

The fluorescent display tube shown in FIG. 3 can be used as the dial display unit of a digitally set radio receiver as disclosed in U.S. Patent application Ser. No. 783,060 invented by Amaya et al. The digits of the channel display elements 42*a* and 42*b* of this embodiment which represent AM, FM or other frequencies may be formed by coating material or by not coating the portions corresponding to the digits. In the latter case, portions other than the digits or symbols are of course coated. The second display unit may be used to display other receiving bands in parallel with AM and FM displays.

In the fluorescent display tube shown in FIGS. 1 and 2, the first display unit was constructed to display a bar graph whereas the second display unit to display digits but it is possible to display digits by the first display unit, and a bar graph by the second display unit.

Figure 4:
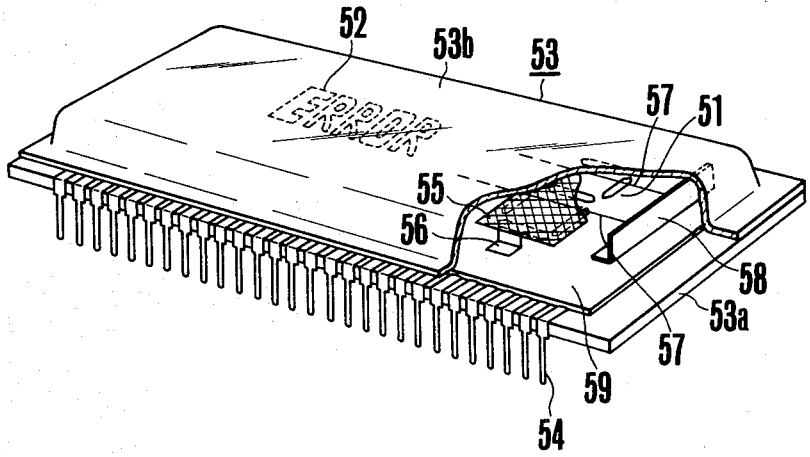
FIGS. 4, 5 and 6 are perspective views, partly broken away, showing still other embodiments of this invention.

Alternatively, as shown in FIG. 4, the first display unit 51 may be used to display digits and the second display unit 52 letters, for example a word "ERROR". In this case, the second display unit 52 should be constituted by transparent electrodes and transparent phosphor films applied thereon. With this fluorescent display tube it is possible to display errors occurring during the operation of an computer by the second display unit, thus giving an alarm to the operator.

In the embodiment shown in FIG. 4, the envelope 53 is made up of a substrate 53*a* and a cover 53*b*. The first display unit 51 comprises a plurality of segments which are arranged in the form of a letter 8 in the same manner as in the second display unit 24 shown in FIGS. 1 and 2. Each segment comprises an electrode and a phosphor film applied thereon. This electrode and a wiring layer for connecting it to an external terminal 54 may not be transparent. The wiring layer and the electrode are interconnected by well known multilayer wiring technique. The display tube further comprises mesh shaped grids, supports 56 thereof, cathode filament 57 supported by anchors 58 and an insulating film 59 which is used to insulate the multilayer wirings.

Figure 5:
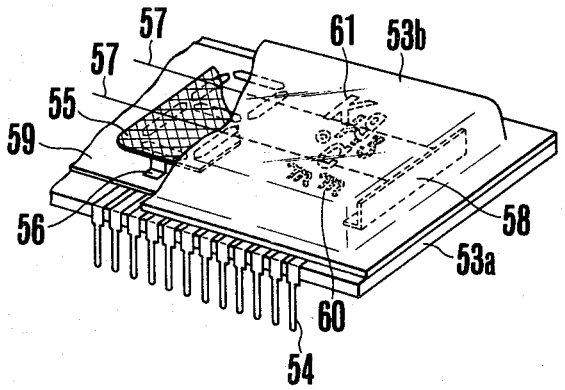

FIG. 5 shows a still another modification of this invention in which the digits displayed by the first display unit are applied with symbols representing the units of the displayed digits. In this example, a symbol 60 representing "Hz" and "mm" is formed on the substrate at the first display unit while a symbol 61 representing "Kg" and "°C." is formed on the inner surface of the cover **53*b* as the second display unit, thus displaying digits with appropriate units. The construction of the other elements of this embodiment is identical to that of the corresponding elements shown in FIG. 4**.

Figure 6:
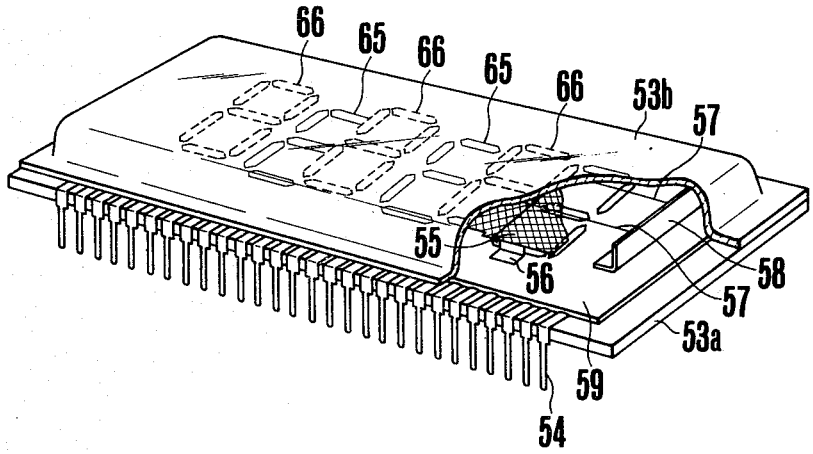

In another embodiment shown in FIG. 6, both the first and second display units are used to display digits and the digits 66 of the second display unit are formed on the inner wall of a cover **53*b* of an envelope 53 to oppose the areas between the digits 65** of the first display unit. With this construction, it is possible to operate either one or both of the first and second display units. Such simultaneous display can decrease the spacing between adjacent display digits thus providing high density display with small interdigit spacings.

In all embodiments described above, it is possible to use different phosphors for the first and second display units so as to display the digits of these units with different colors.

Instead of constituting the envelope with a flat substrate and an inverted dish shaped cover, it is also possible to fabricate the envelope with a pair of flat plates spaced by a spacer interposed therebetween. In the latter case, where all terminals are formed on one substrate as in the foregoing embodiments, the connections may be made by using well known electroconductive rubber. Alternatively, terminals may be formed on each substrate. As above described, in the fluorescent display tube of this invention, since a second display unit is formed on the inner surface of the cover, it is possible to display a large quantity of information with a fluorescent display tube of a definite size, thus widening the field of application of the display tube. Moreover, as the first and second display units utilize a common filament it is not necessary to increase the number of component elements in proportion to the increase in the display capacity.

What is claimed is:

1. In a fluorescent display tube comprising a sealed envelope made up of spaced plates one of which being transparent, a first display unit formed on the inner surface of a plate opposing said transparent plates, said first display unit including a plurality of electrodes and phosphor films coated thereon, a cathode electrode for emitting thermal electrons, and drive means for selectively energizing said electrodes for causing said phosphor films to luminesce with said thermal electrons, the improvement which comprises a second display unit which includes a plurality of separately driven electrodes formed on the inner surface of said transparent plate and phosphor films coated on the last mentioned electrodes.

2. A fluorescent display tube according to claim 1 wherein said second display unit comprises transparent electrodes and transparent phosphors coated thereon, and said second display unit is positioned to oppose said first display unit.

3. A fluorescent display tube according to claim 1 wherein said second display unit comprises transparent electrodes and opaque phosphor films coated thereon, and said second display unit is disposed not to oppose said first display unit.

4. A fluorescent display tube according to claim 1 wherein said phosphor films of said first and second display units emit lights of different colors.

5. A fluorescent display tube comprising a sealed envelope made up of spaced-apart generally parallel plates at least one of which is transparent, a first display unit formed on the inner surface of a plate opposing said transparent plate and comprising a plurality of fluorescent segments formed by electrodes secured on said plate and having phosphor films coated thereon, said fluorescent segments being arranged to selectively display a physical displacement in accordance with the position thereof, a second display unit comprising a plurality of electrodes formed on the inner surface of said transparent plate and having phosphor films formed in a fluorescent pattern representing a value used in the interpretation of the position of said fluorescent segments of said first display unit, a cathode electrode common to both the first and second display units for emitting thermal electrons, and drive means for selectively energizing the electrodes of said first and second display units, respectively, for causing said phosphor films to luminesce.

6. A fluorescent display tube according to claim 5 wherein the fluorescent segments of said first display unit are arranged to form a pattern representing the value of a received frequency of a radio broadcasting system in accordance with the position of said fluorescent segment, and the luminous patterns of said second display unit are formed independently in accordance with the band of the received frequency.

7. A fluorescent display tube for use in a dial display unit of a radio receiver comprising a sealed envelope with one side wall made of transparent material, a series of fluorescent segments comprised by a plurality of electrodes having phosphor films coated thereon formed on the inner surface of the other side wall opposing said transparent side wall, first drive means for selecting said fluorescent segments in accordance with the frequency of the wave received by said receiver, a fluorescent channel display member formed on the inner surface of said transparent side wall, said channel display member being comprised by a plurality of electrodes having phosphor films coated thereon and shaped in the form of letters which display the frequency band in which a plurality of received frequencies lie, a cathode electrode for emitting electrons, and second drive means for separately energizing the electrodes of said fluorescent channel display member in accordance with the received frequency band information.

* * * * *